US005630393A

United States Patent [19]

Grzesiak

[11] Patent Number: 5,630,393

[45] Date of Patent: May 20, 1997

[54] ANTI-TURBO DEVICE

[76] Inventor: Jaroslaw Grzesiak, 3219 N. Neenah, Chicago, Ill. 60634

[21] Appl. No.: 609,429

[22] Filed: Mar. 1, 1996

[51] Int. Cl.[6] ..... F02D 9/10; F02D 9/12

[52] U.S. Cl. ..... 123/336; 123/337; 137/614.11; 251/322

[58] Field of Search ..... 123/336, 337, 123/442; 137/614.11, 614.19; 138/45; 251/322

[56] References Cited

U.S. PATENT DOCUMENTS

| | | | |
|---|---|---|---|
| 688,836 | 12/1901 | Diehl | 137/614.11 X |
| 1,289,425 | 12/1918 | Fekete | 123/337 X |
| 4,094,289 | 6/1978 | Wessel et al. | 123/337 |

*Primary Examiner*—Tony M. Argenbright

[57] ABSTRACT

A anti-turbo device including a housing unit that has a first end with an intake pipe interconnected, and a second end with an exhaust pipe interconnected. The housing unit is capable of having a flow of air flowing from the intake pipe through to the exhaust pipe. An air pedal projects from a top portion of the housing. The air pedal has a short member interconnected an elongated member. The short member is coupled with a linkage of a gas pedal. Lastly, a baffle is included. The baffle has a top side with a distal end of the elongated member, of the air pedal, interconnected. The air pedal is capable of moving the baffle when the linkage is moved by the air pedal. The baffle has a bottom peripheral edge that is spaced from a bottom interior portion of the housing. The bottom peripheral edge is capable of modulating the air flow through the housing, when the linkage moves the air pedal.

8 Claims, 3 Drawing Sheets

FIG 5
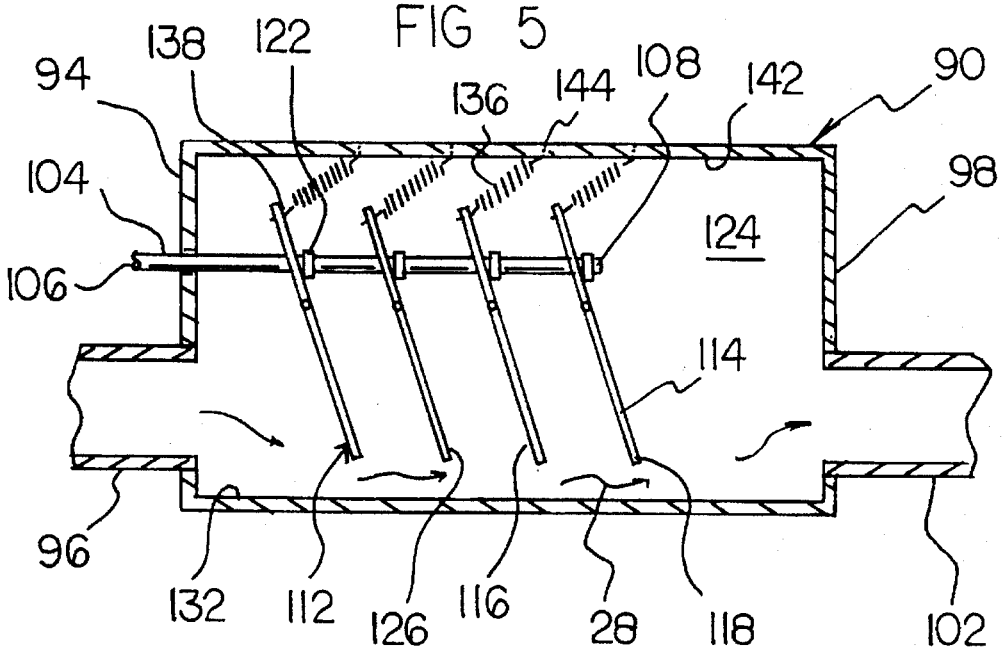
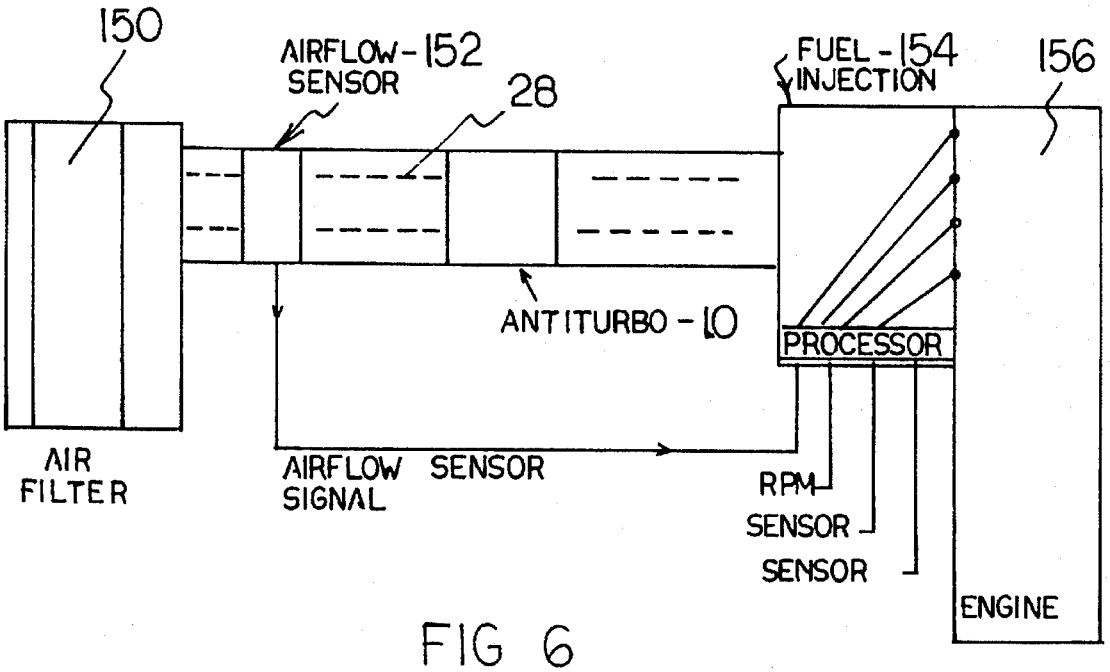
FIG 6

ANTI-TURBO DEVICE

BACKGROUND OF THE INVENTION

1. Field of the Invention

The present invention relates to a anti-turbo device and more particularly pertains to providing an air flow controlling mechanism that is comprised of a housing unit having a baffle therein, and further allowing the baffle to be operable with the linkage of a gas pedal.

2. Description of the Prior Art

The use of air flow system is known in the prior art. More specifically, air flow systems heretofore devised and utilized for the purpose of introducing air into the combustion chamber are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,349,811 to Stickler, Swallom, Goidfarb and Sadoznik, discloses a pulsed fuel injection system for reducing $NO_x$ emissions. U.S. Pat. No. 4,597,364 to Young discloses a fuel control system for gaseous fueled engines. U.S. Pat. No. 4,570,603 to Piedrafita discloses an apparatus for improving gasoline consumption, power and reducing emission pollutants of internal combustion engines. U.S. Pat. No. 4,498,288 to Vogt discloses a fuel injection stage sectoral combustor for burning low-btu fuel gas. U.S. Pat. No. 4,354,476 to Spranbel discloses an apparatus for controlling the recirculated exhaust gas quantities and the injection quantity in auto-igniting internal combustion engines. Lastly, U.S. Pat. No. 4,253,301 to Vogt discloses a fuel injection stage sectoral combustor for burning low-btu fuel gas.

While these devices fulfill their respective, particular objectives and requirements, the aforementioned patents do not describe an anti-turbo device that provides a precise air flow regulator valve, that is a part of the air-fuel intake system and works in cooperation with the fuel injection system.

In this respect, the anti-turbo device according to the present invention substantially departs from the conventional concepts and designs of the prior art, and in doing so provides an apparatus primarily developed for the purpose of providing an air flow controlling mechanism that is comprised of a housing unit having a baffle therein, and further allowing the baffle to be operable with the linkage of a gas pedal.

Therefore, it can be appreciated that there exists a continuing need for a new and improved anti-turbo device which can be used for providing an air flow controlling mechanism that is comprised of a housing unit having a baffle therein, and further allowing the baffle to be operable with the linkage of a gas pedal. In this regard, the present invention substantially fulfills this need.

SUMMARY OF THE INVENTION

In view of the foregoing disadvantages inherent in the known types of air flow systems now present in the prior art, the present invention provides an improved anti-turbo device. As such, the general purpose of the present invention, which will be described subsequently in greater detail, is to provide a new and improved anti-turbo device and method which has all the advantages of the prior art and none of the disadvantages.

To attain this, the present invention essentially comprises a generally rectangular housing unit that has a first end and a second end. The first end has an intake pipe that is interconnected and projects outwardly. The second end has an exhaust pipe that is interconnected and projects outwardly. The housing unit is capable of receiving an air flow from the intake pipe. The air flow is capable of exiting from the housing through the exhaust pipe. Included is an air pedal. The air pedal projects from a top portion of the housing. The air pedal has a short member and an elongated member that are interconnected. The short member and the elongated member are interconnected to give the air pedal a generally L-shaped appearance. The short member of the air pedal has a proximal end, while the elongated member has a distal end. The short member is coupled with a linkage of a gas pedal to allow movement of the air pedal in an upwardly and downwardly direction within the top portion. Also, a generally rectangular baffle is formed of a rigid material and included. The baffle has a top side, a bottom side and a peripheral edge therearound. The top side of the baffle has the distal end of the air pedal interconnected. The air pedal is capable of moving the baffle, when the linkage moves the air pedal. The distal end is centrally positioned on the top side and spaced from a top peripheral edge of the baffle. The baffle has a bottom peripheral edge that is spaced from a bottom interior portion of the housing. The baffle is axonometric within the housing, and with respect to the planes of the housing. The bottom peripheral edge of the baffle is capable of modulating the air flow through the housing, when the linkage moves the air pedal upwardly and downwardly. Lastly, a return spring is attached to the top side of the baffle at one end, and an interior top portion of the housing at another end. The spring is capable of having the elongated member of the air pedal positioned therethrough. The return spring is capable of recoiling to return the baffle, for restricting the air flow through the housing, and pushing the air pedal upward when the gas pedal is released.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anti-turbo device which has all of the advantages of the prior art air flow systems and none of the disadvantages.

It is another object of the present invention to provide a new and improved anti-turbo device which may be easily and efficiently manufactured and marketed.

It is further object of the present invention to provide a new and improved anti-turbo device which is of durable and reliable constructions.

An even further object of the present invention is to provide a new and improved anti-turbo device which is susceptible of a low cost of manufacture with regard to both materials and labor, and which accordingly is then susceptible of low prices of sale to the consuming public, thereby making such anti-turbo device economically available to the buying public.

Still yet another object of the present invention is to provide a new and improved anti-turbo device which provides in the apparatuses and methods of the prior art some of the advantages thereof, while simultaneously overcoming some of the disadvantages normally associated therewith.

Even still another object of the present invention is to provide a anti-turbo device for providing an air flow controlling mechanism that is comprised of a housing unit having a baffle therein, and further allowing the baffle to be operable with the linkage of a gas pedal.

Lastly, it is an object of the present invention to provide a new and improved anti-turbo device including a housing unit that has a first end with an intake pipe that is interconnected, and a second end with an exhaust pipe that is interconnected. The housing unit is capable of having a flow of air flow from the intake pipe through to the exhaust pipe. An air pedal projects from a top portion of the housing. The air pedal has a short member being interconnected an elongated member. The short member is coupled with a linkage of a gas pedal. Lastly, a baffle is included. The baffle has a top side with a distal end of the elongated member, of the air pedal, interconnected. The air pedal is capable of moving the baffle when the linkage is moved by the air pedal. The baffle has a bottom peripheral edge that is spaced from a bottom interior portion of the housing. The bottom peripheral edge is capable of modulating the air flow through the housing, when the linkage moves the air pedal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view of an alternative embodiment of the present invention.

FIG. 6 is a block diagram illustrating the air flow through the present invention and into the engine.

The same reference numerals refer to the same parts through the various Figures.

DESCRIPTION OF THE PREFERRED EMBODIMENT

Figure 1:
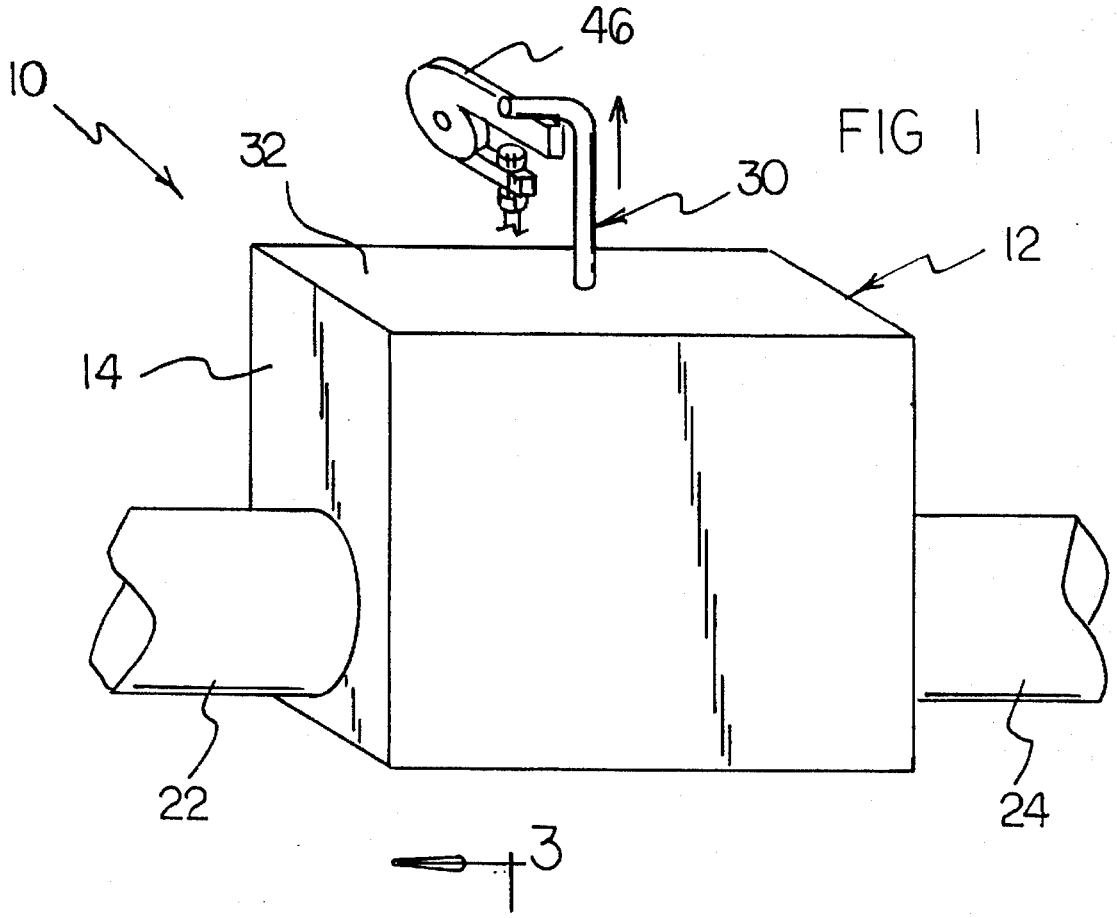
FIG. 1 is a perspective view of the preferred embodiment of the anti-turbo device constructed in accordance with the principles of the present invention.
Figure 2:
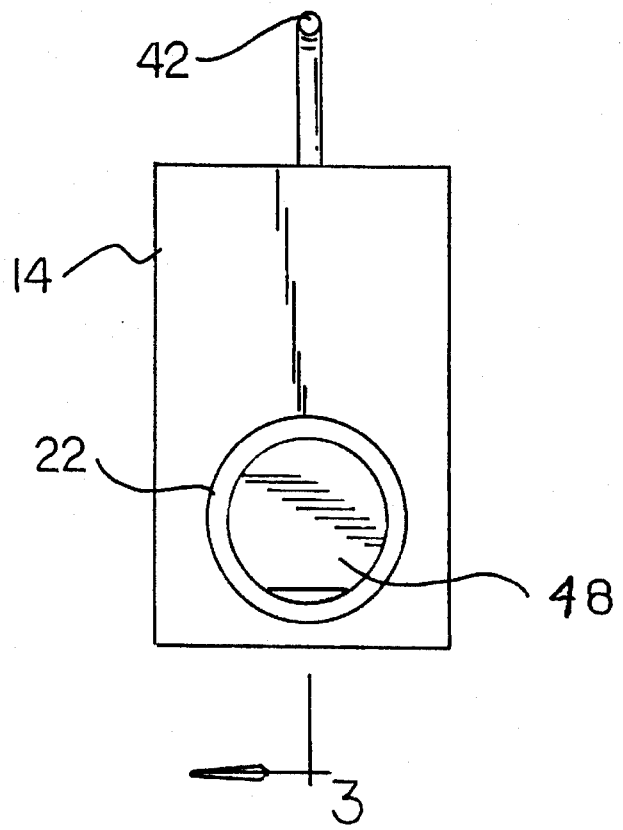
FIG. 2 is a frontal view of the present invention as shown in FIG. 1.

With reference now to the drawings, and in particular to FIG. 1 thereof, the preferred embodiment of the new and improved anti-turbo device embodying the principles and concepts of the present invention and generally designated by the reference numeral 10 will be described.

The present invention, the anti-turbo device 10 is comprised of a plurality of components. Such components in their broadest context include a housing, an air pedal and a baffle. Such components are individually configured and correlated with respect to each other so as to attain the desired objective.

Figure 3:
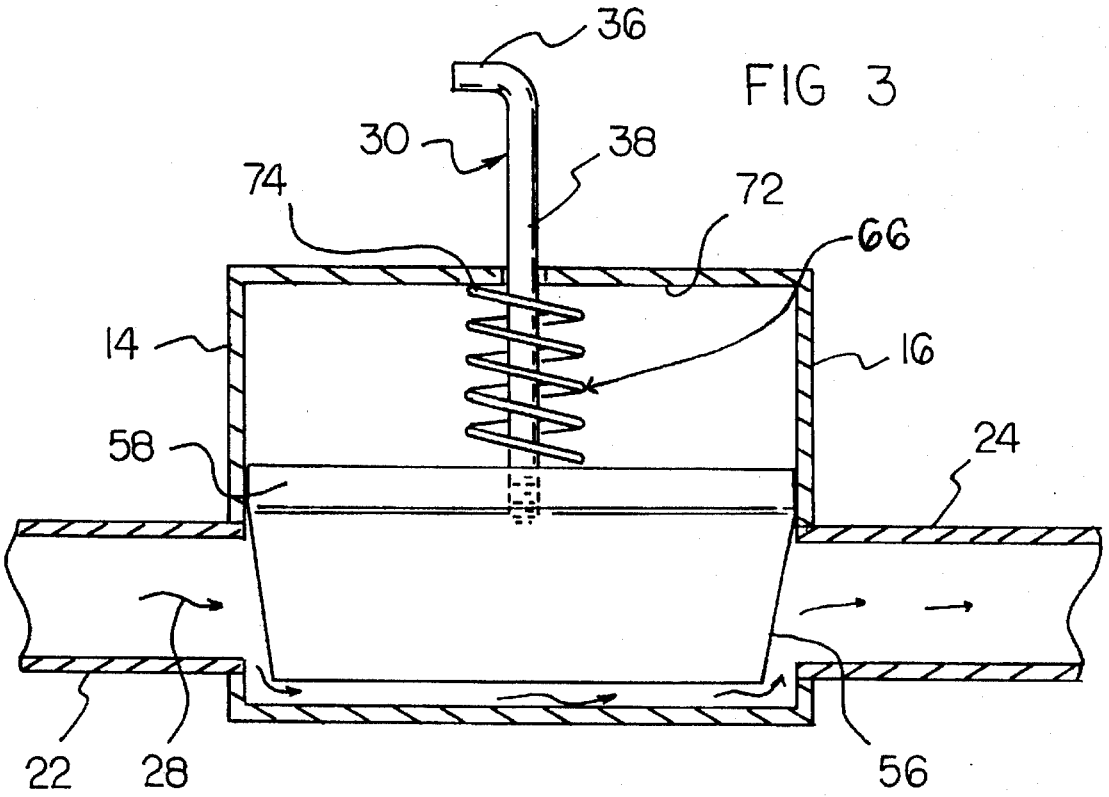
FIG. 3 is a cross sectional view of the present invention taken along line 3—3 of FIG. 2, showing the baffle in a closed position.
Figure 4:
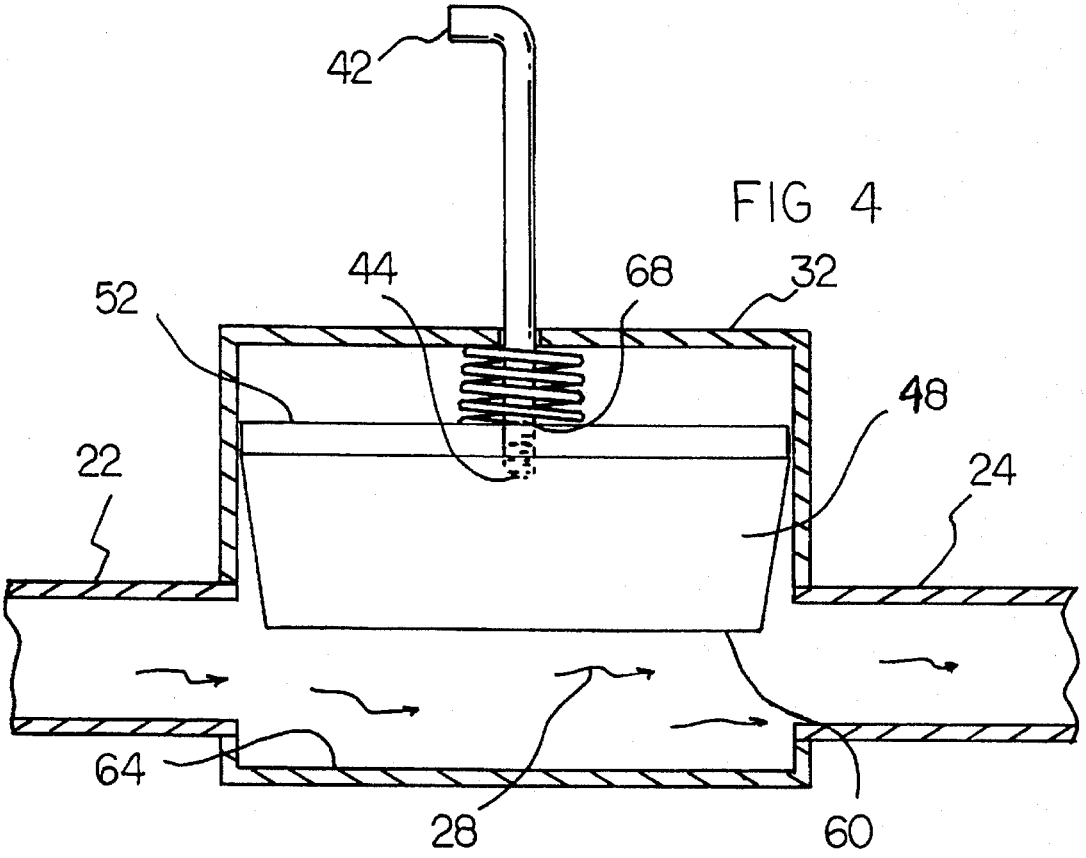
FIG. 4 is a cross sectional view of the present invention as shown in FIG. 3, and showing the baffle open in the present invention.

Specifically, the present invention includes a generally rectangular housing until 12. The housing unit is formed of a rigid plastic, such as polyvinylchloride. The housing unit has a first end 14 and a second end 16, as shown in FIG. 3. The first end has an intake pipe 22 that is interconnected and projects outwardly. The second end has an exhaust pipe 24 that is interconnected and projects outwardly. The intake pipe and the exhaust pipe are both made of the same plastic used in making the housing. The housing unit with the pipes may be formed through an injection molding process. As seen in FIG. 4, the housing unit receives an air flow 28 from the intake pipe. Once the air enters the housing it exits from the housing through the exhaust pipe.

Also, an air pedal 30 projects from a top portion 32 of the housing 12. The air pedal, preferably, is formed of a metal of metal alloy. The air pedal may be formed of a rigid plastic. As shown in FIG. 3, the air pedal 30 has a short member 36 and an elongated member 38 that are interconnected. The short member and the elongated member, by being interconnected, gives the air pedal a generally L-shaped appearance. The short member of the air pedal has a proximal end 42, while the elongated member has a distal end 44. As shown in FIG. 1, the short member is coupled with a linkage 46 of a gas pedal. The linkage is able to move the air pedal in an upwardly and downwardly direction within the top portion. When the gas pedal is pressed, the air pedal is pulled upward. When the pressure is taken away from the gas pedal, the air pedal is released and moved downward. The pressure that is applied to the gas pedal determines how much the linkage will move the air pedal up and down. The more pressure applied to the gas pedal, the further the air pedal is pulled upward.

As best illustrated in FIGS. 3 and 4, a generally rectangular baffle 48 is provided. The baffle is formed of a rigid material, that may be either metal or plastic. The baffle has a top side 52, a bottom side 54 and a peripheral edge 56. The top side of the baffle has the distal end 44 of the air pedal interconnected. The air pedal may be welded to the baffle, but preferably, the air pedal is threaded attached to the baffle. The air pedal 30 moves the baffle when the linkage 46 moves the air pedal. The distal end is centrally positioned on the top side and spaced from a top peripheral edge 58 of the baffle.

The baffle has a bottom peripheral edge 60, as seen in FIG. 4, that is spaced from a bottom interior portion 64 of the housing 12. The baffle is axonometric within the housing and with respect to the planes of the housing. The bottom peripheral edge of the baffle is capable of modulating the air flow through the housing, when the linkage moves the air pedal upwardly and downwardly. As seen in FIG. 3, when the air pedal is down the air flow 28 is restricted, and when the air pedal is up the air has continuous movement.

Lastly, a return spring 66 is attached to the top side 52 of the baffle 48 at one end 68, and an interior top portion 72 of the housing at another end 74. The spring is any commercially available compression spring of the type used in connection with the acceleration system of an automobile or motorcycle. The return spring has the elongated member of the air pedal positioned therethrough. The return spring is capable of recoiling to return the baffle and push the air pedal upward when the gas pedal is released. Releasing the gas pedal will restrict the air flow through the housing.

FIG. 5 shows an alternative embodiment of the anti-turbo device. This embodiment includes a generally rectangular housing unit 90. The housing unit has a first end 94 with an intake pipe 96 that is interconnected, and a second end 98 that has an exhaust pipe 102 interconnected. The housing unit is capable of receiving a flow of air 28 therein by way of the intake pipe, with the air exiting through the exhaust pipe.

Also, an elongated air pedal 104 projects from the first end of the housing, and is spaced from the intake pipe 96. The air pedal has a proximal end 106 and a distal end 108. The proximal end is coupled with a linkage 46 of a gas pedal. The linkage is similar to the linkage of FIG. 1 and allows movement of the air pedal in a backward and forward direction from the first end 94 of the housing.

Additionally, a plurality of generally rectangular baffles 112 are provided. Each baffle is formed of a rigid material and has the air pedal positioned therethrough. Each baffle has a top side 114, a bottom side 116 and a peripheral edge 118. The air pedal has a plurality of stop rings 122 adjacent each top side of each baffle. The stop rings prevent the air pedal from being removed from each baffle, when the linkage is moved by the gas pedal. Each baffle is attached at two peripheral side edges to an interior side wall 124 of the housing. Each baffle has a bottom peripheral edge 126 that is spaced from a bottom interior portion 132 of the housing. Each baffle is axonometric within the housing and with respect to the planes of the housing. The bottom peripheral edge of each baffle is capable of modulating the air flow through the housing when the linkage moves the air pedal.

Lastly, the alternative embodiment includes a plurality of return springs 136. Each return spring is attached to the top side 114 of each baffle at one end 138, and an interior top portion 142 of the housing at another end 144. Each return spring is capable of recoiling to return the baffle, an pull the air pedal inwardly when the gas pedal is released, to restrict the air flow through the housing.

The continuous operation of the engine is determined by the combustion of fuel/air. The fuel is introduced through fuel injectors in the form of a fine spray. The air, is compressed, an introduced into the combustion chamber through an air filter 150, as shown in FIG. 6. As part of the combustion engine, once the air passes through the air filter, it passes through a series of chambers and eventually it will pass through an air flow sensor 152. Continuing on its path, the air 28 flows through the anti-turbo device of the present invention. Once the air leaves the anti-turbo device and exits through the exhaust, it enters into the combustion chamber. The block diagram of FIG. 6 shows the direction in which the air flows to reach the chamber. The anti-turbo device will regulate the air input into the fuel injection system 154 for the sequential fuel-air mixture and reaction that occurs prior to fuel being sprayed. Once the fuel mixture has occurred, it is sprayed into the combustion chamber of the engine 156. This mixture directly increases the overall engine efficiency.

The present invention is anti-turbo device is a precise air flow regulator valve. It comes into operation when the gas pedal is either pressed or released. The anti-turbo device is part of the air-fuel intake system and has to work in cooperation with the fuel injection system. The anti-turbo device does not measure the air flow, nor does it send any signals to the fuel injection processor. The anti-turbo device precisely regulates the engine air intake. The ideal anti-turbo device would warranty that for constant air pedal pressure, the air flow through the device would depend only on the rpms. The valve, anti-turbo device, will not cause significant air vibrations or turbulence when it passes therethrough. The change in the air pedal caused by pressure being applied to the gas pedal would cause exactly the same change in the value of the air flow going through the device. For instance: if you have a rpm of 2,500 and the driver puts 33 percent more pressure on the gas pedal, that means 33 percent more air gets through the device. As the anti-turbo device changes the air intake to the engine, the air sensor measures the air flow and sends a signal to the fuel injection processor. The processor combines the air flow that is measured with the rpm and other intakes like engine temperature and outside pressure. The processor finds the maximum value of fuel that can be efficiently burned in these conditions. The maximum fuel value is injected to the engine.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anti-turbo device for regulating the flow of air into a fuel injector system of an engine comprising in combination:

a generally rectangular housing unit having a first end and a second end, the first end having an intake pipe being interconnected and projecting outwardly therefrom, the second end having an exhaust pipe being interconnected and projecting outwardly therefrom, the housing unit capable of receiving a flow of air from the intake pipe, the air flow being capable of exiting from the housing through the exhaust pipe;

an air pedal projecting from a top portion of the housing, the air pedal having a short member and an elongated member being interconnected, the short member and the elongated member being interconnected to give the air pedal a generally L-shaped appearance, the short member of the air pedal having a proximal end while the elongated member having a distal end, the short member being coupled with a linkage of a gas pedal for allowing movement of the air pedal in an upwardly and downwardly direction within the top portion;

a generally rectangular baffle being formed of a rigid material, the baffle having a top side, a bottom side and a peripheral edge therearound, the top side of the baffle having the distal end of the air pedal being interconnected thereto, the air pedal being capable of moving the baffle when the linkage moves the air pedal, the distal end being centrally positioned on the top side and spaced from a top peripheral edge of the baffle, the baffle having a bottom peripheral edge being spaced from a bottom interior portion of the housing, the baffle being axonometric within the housing and with respect to the planes of the housing, the bottom peripheral edge of the baffle being capable of modulating the air flow through the housing when the linkage moves the air pedal upwardly and downwardly; and a return spring being attached to the top side of the baffle at one end and an interior top portion of the housing at another end, the spring being capable of having the elongated member of the air pedal positionable therethrough, the return spring being capable of recoiling to return the baffle and pushing the air pedal upward when the gas pedal is released for restricting the air flow through the housing.

2. An anti-turbo device comprising:

a housing unit having a first end with an intake pipe being interconnected and a second end having an exhaust pipe being interconnected, the housing unit being capable of having a flow of air flowing from the intake pipe through to the exhaust pipe;

an air pedal projecting from a top portion of the housing and having a short member being interconnected with an elongated member, the short member being coupled with a linkage of a gas pedal; and a baffle having a top side with a distal end of the elongated member of the air pedal being interconnected, the air pedal being capable of moving the baffle when the linkage is capable of moving the air pedal, the baffle having a bottom peripheral edge being spaced from a bottom interior portion of the housing, the bottom peripheral edge being capable of modulating the air flow through the housing when the linkage moves the air pedal.

3. The anti-turbo device as set forth in claim 2 wherein the intake pipe is projected outwardly from one side of the housing and the exhaust pipe is projected outwardly from another side of the housing, and the air flow entering the housing through the intake pipe and exiting the housing through the exhaust pipe.

4. The anti-turbo device as set forth in claim 2 wherein the short member and the elongated member are interconnected to give the air pedal a generally L-shaped appearance, the elongated member having a distal end, and the air pedal being capable of moving in an upwardly and downwardly direction within the top portion when the linkage of the gas pedal is moved.

5. The anti-turbo device as set forth in claim 2 wherein the baffle is a rigid solid having a generally rectangular shape, the baffle having a bottom side and a peripheral edge therearound, the distal end being centrally positioned on the top side and spaced from a top peripheral edge of the baffle, the baffle being axonometric within the housing and with respect to the planes of the housing.

6. The anti-turbo device as set forth in claim 5 wherein a return spring is attached to the top side of the baffle at one end and an interior top portion of the housing at another end, and the return spring being capable of having the elongated member of the air pedal positionable therethrough.

7. The anti-turbo device as set forth in claim 6 wherein the return spring is capable of recoiling to return the baffle and pushing the air pedal upward when the gas pedal is released for restricting the air flow through the housing.

8. A anti-turbo device for regulating the flow of air into a fuel injector system of an engine comprising:

a generally rectangular housing unit having a first end with an intake pipe being interconnected and a second end having an exhaust pipe being interconnected, the housing unit being capable of receiving a flow of air therein through the intake pipe and capable of exiting through to the exhaust pipe;

an elongated air pedal projecting from the first end of the housing and spaced from the intake pipe, the air pedal having a proximal end and a distal end, the proximal end being coupled with a linkage of a gas pedal for allowing movement of the air pedal in a backward and forward direction through the first end of the housing;

a plurality of generally rectangular baffles, each baffle being formed of a rigid material and having the air pedal being positionable therethrough, each baffle having a top side, a bottom side and a peripheral edge therearound, the air pedal having a plurality of stop rings adjacent each top side of each baffle for preventing the air pedal from being removed from each baffle when being moved by the linkage, each baffle being attached to at each peripheral side edge to an interior side wall of the housing, each baffle having a bottom peripheral edge being spaced from a bottom interior portion of the housing, each baffle being axonometric within the housing and with respect to the planes of the housing, the bottom peripheral edge of each baffle being capable of modulating the air flow through the housing when the linkage moves the air pedal; and a plurality of return springs being attached to the top side of each baffle at one end and an interior top portion of the housing at another end, each return spring being capable of recoiling to return the baffle and pulling the air pedal inwardly when the gas pedal is released for restricting the air flow through the housing.

* * * * *